United States Patent [19]

Burge

[11] 4,035,947

[45] July 19, 1977

[54] TOY CONSTRUCTION SET HAVING INTERCONNECTIBLE COMPONENTS WITH INTERFITTING FORMATIONS

[76] Inventor: David A. Burge, 3594 Glencairn Road, Shaker Heights, Ohio 44122

[21] Appl. No.: 606,348

[22] Filed: Aug. 21, 1975

[51] Int. Cl.[2] ..... A63H 33/08

[52] U.S. Cl. ..... 46/25

[58] Field of Search ..... 46/25, 26

[56] References Cited

U.S. PATENT DOCUMENTS

| | | | |
|---|---|---|---|
| 615,832 | 12/1898 | Fields | 46/25 UX |
| 1,894,061 | 1/1933 | Sanders | 46/25 |
| 2,107,691 | 2/1938 | Corser | 46/26 X |
| 2,202,956 | 6/1940 | Lee | 46/26 UX |
| 2,923,551 | 2/1960 | Pope | 46/25 X |
| 3,032,919 | 5/1962 | Amsler | 46/25 |
| 3,310,906 | 3/1967 | Glukes | 46/25 |
| 3,410,474 | 11/1968 | Keil | 46/25 UX |
| 3,479,763 | 11/1969 | Fischer | 46/25 |
| 3,513,590 | 5/1970 | Fischer | 46/25 |
| 3,566,531 | 3/1971 | Hasel | 46/25 |

FOREIGN PATENT DOCUMENTS

| | | | |
|---|---|---|---|
| 217,252 | 9/1958 | United Kingdom | 46/25 |

*Primary Examiner*—F. Barry Shay
*Attorney, Agent, or Firm*—David A. Burge Co.

[57] ABSTRACT

Components of a toy construction set carry undercut male connectors and have elongated grooves for receiving the male connectors to interconnect the components. The grooves have first and second portions. The first groove portions are configured to receive and retain a male connector which has been compressively inserted into such first portions by relatively moving the connector along any one of a plurality of possible insertion paths including a path extending transversely of the longitudinal direction of the associated groove. The second portions are configured to receive and retain a male connector which has been slided longitudinally of the associated groove into engagement with such second portions. In one embodiment, the first groove portions are undercut to a lesser degree than are the second portions. In another embodiment, the first groove portions are not undercut at all but rather are configured to interference fit with a male connector, while the second portions are undercut. In both embodiments, the second portions inhibit to a greater extent than do the first portions any disconnection of the components by relative movement of the components in directions transverse to the length of their respective groove portions.

9 Claims, 13 Drawing Figures

TOY CONSTRUCTION SET HAVING INTERCONNECTIBLE COMPONENTS WITH INTERFITTING FORMATIONS

REFERENCE TO RELEVANT PATENTS

Assembly Kit Having Dovetail Connection With Reduced Contact Area, U.S. Pat. No. 3,479,763 issued Nov. 25, 1969 to Artur Fischer, here the "Undercut Slot Patent," the disclosure of which is incorporated by reference.

Blocks Connectable By Lateral Sliding, Including Means For Reducing Sliding Contact, U.S. Pat. No. 3,513,590 issued May 26, 1970 to Artur Fischer, here the "End Connector Patent," the disclosure of which is incorporated by reference.

BACKGROUND OF THE INVENTION

1. Field of the Invention

The present invention relates to construction sets, and more particularly to a toy construction set including components having interfitting formations connectible in a plurality of manners to releasably interconnect the components.

2. Prior Art

Toy construction sets are known which utilize a plurality of interconnectable structural components. The components typically are provided with male, female, or male and female coupling portions so that they can be connected by mating complementary coupling portions or by using separate coupling elements. Such construction sets are described in the referenced Undercut Slot Patent and the referenced End Connector Patent.

The construction set components described in the referenced patents have undercut male connector formations which are receivable in elongated undercut grooves. A characteristic of such construction set components is that they can only be connected and disconnected by relatively moving the components along paths paralleling the longitudinal directions of their undercut grooves. In one respect this characteristic is advantageous in that it inhibits ready disconnection of interconnected components by pulling them apart in directions transverse to the length of their grooves, i.e., they establish relatively strong tension connections. In another respect, however, this characteristic provides the significant drawback of limiting the manner in which components can be relatively moved to effect their interconnection. The components cannot, for example, be moved toward each other in directions transverse to the length of their grooves to press or "snap" the components together.

Construction set components have been proposed which have male and female formations that can be moved toward and away from each other to establish and release component interconnection. One such proposal utilizes component formations that deform slightly during insertion and retraction to provide snap-together connections. Another proposal utilizes component formations that are simply pressed together and pulled apart to establish and release interference fitting connections. Still another proposal utilizes snap-together components which, once they are interconnected, also interference fit to assist in establishing relatively rigid connections. A drawback of all these proposals is that their connector formations are disconnectible relatively easily by pulling the interconnected parts apart. They do not, in short, establish relatively strong tension connections.

Another drawback of previous connector proposals has been their lack of versatility. No known sets have permitted either a relatively low tensile strength or a relatively high tensile strength connection to be established depending on which of a plurality of interconnectible formations are interconnected. A further drawback has been their failure to permit a shifting between relatively low and high tensile strength interconnections without disconnecting a pair of already interconnected components. Still another drawback has been the failure of previously proposed connector embodiments to permit the establishment of a relatively high strength tensile connection by relatively moving a pair of interconnectible components first into a relatively low tensile strength connection attitude and subsequently into a relatively high tensile strength connection attitude whereby the high strength connection is actually established in two distinct steps or stages.

SUMMARY OF THE INVENTION

The present invention overcomes the foregoing and other drawbacks of the prior art and provides a highly versatile construction set with components that are interconnectible in a plurality of manners to selectively establish relatively low and relatively high tensile strength connections.

The construction set components have engageable interfitting formations configured to securely releasably connect the components when such formations are interfittingly engaged. Considering a pair of such components, the formation on one component is associated with a face of the one component and is undercut in directions extending transversely of such face, while the formation on the other component includes two formation portions. One of the formation portions is undercut and adapted to slidingly engage the formation on the one component when the pair of components are moved relatively to slide the one formation portion parallel to such face and into sliding engagement with the undercut formation on the one component. The other of the formation portions is configured to receive and releasably retain the undercut formation on the one component when the pair of components are moved relatively transversely of such face to interfittingly engage the other formation portion and the undercut formation on the one component.

The described formation portions are preferably undercut to different degrees. The adjective "undercut" is used here in its usual sense to refer to the characteristic of having under material cut away or absent such that an outer portion of material is left standing out in relief.

The interfitting formations preferably include male connector formations and grooves configured to receive and securely, releasably retain the connector formations. In preferred practice, the male connector formations on all components are undercut to a common degree and are identical in size and shape, while the grooves have portions which are undercut to different degrees.

In one embodiment, one of the described groove portions is not undercut at all but rather is simply configured to receive in an interference fit a male connector formation inserted therein. The other of the groove portions is elongated, undercut, and configured to receive a male connector formation inserted as by sliding longitudinally of such other groove portion.

In another embodiment, the described groove portions are undercut to different degrees, whereby one of the groove portions will receive a connector pressed into it in a snap-together fashion, while the other of the groove portions will only receive a connector inserted longitudinally in a sliding movement.

In both of these embodiments, the one groove portions establish a relatively low tensile strength connection with a male connector formation, while the other groove portions establish a relatively high tensile strength connection.

In the preferred practice of either embodiment, the first and second groove portions are located side-by-side and form portions of a common elongated groove. This arrangement permits a male connector formation to be inserted transversely of the groove into a first groove portion, whereafter the male connector can be slided longitudinally into engagement with the adjacent second groove portion. A relatively high strength tensile connection is thereby established in two stages with the initial stage providing a relatively low strength tensile connection capable of holding interconnected components together until all is in readiness to effect their relative movement to the high strength connection attitude.

As will be apparent from the foregoing summary, it is a general object of the present invention to provide a novel and improved toy construction set.

It is a further object to provide a novel and improved construction set which can be used to construct a wide variety of structural systems.

It is still another object to provide novel and improved methods of constructing structural systems with a construction set having interconnectable components.

Other objects and a fuller understanding of the invention may be had by referring to the following description and claims taken in conjunction with the accompanying drawings.

DESCRIPTION OF THE PREFERRED EMBODIMENT

Figures 1, 2, 3, 4, 5, 6, 7, 8:
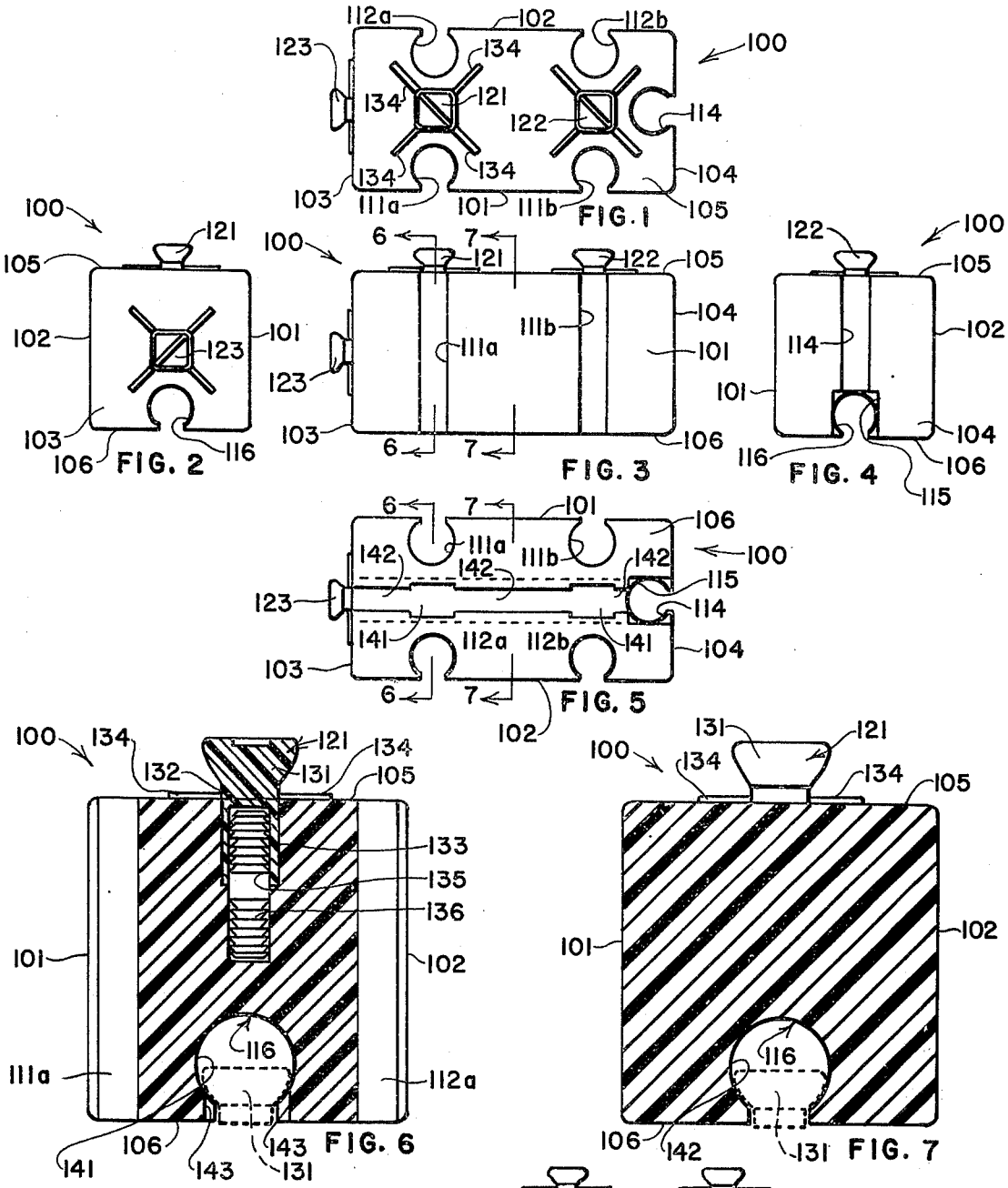
FIG. 1 is a top plan view of the preferred embodiment of a construction set component including certain aspects of the present invention.
FIGS. 2 and 4 are end elevational views of the component of FIG. 1.
FIG. 3 is a side elevational view of the component of FIG. 1.
FIG. 5 is a bottom plan view of the component of FIG. 1.
FIGS. 6 and 7 are enlarged sectional views as seen from planes indicated by lines 6—6 and 7—7 in FIGS. 3 and 5.
FIG. 8 is a side elevational view of a plurality of the components of FIG. 1 with portions of selected components broken away to illustrate how the components interconnect.

Referring to FIGS. 1–5, a construction set component is indicated generally by the numeral 100. The component 100 has substantially the form of a right parallelepiped with six substantially rectangular faces 101, 102, 103, 104, 105, 106. The faces 101–104 will be called side faces of the component 100, the face 105 will be called the top of the component 100, and the face 106 will be called the bottom of the component 100.

A number of grooves are provided in the faces 101, 102, 104, 106. Two of these grooves **111*a*, 111*b* are provided in the side face 101. Similar grooves 112*a*, 112*b* are provided in the side face 102. A similar groove 114 is provided in the side face 104. A groove 116 is provided in the bottom face 106.**

In the preferred embodiment, the grooves **111*a*, 111*b*, 112*a*, 112*b*, 114 are of substantially identical undercut cross-section, while the groove 116 has a specialized cross-section as will be described. Building components having undercut grooves like the grooves 111*a*, 111*b*, 112*a*, 112*b*, 114** are described in the referenced End Connector Patent. As will be appreciated, building set components constructed in accordance with the present invention may be provided with any convenient number of such undercut grooves to facilitate their interconnection with one another and with other components such as are described in the referenced End Connector Patent.

The component 100 is provided with three identical male connector formations or couplers 121, 122, 123. Referring to FIG. 6, the coupler 121 has an upstanding head portion 131 and an integrally formed depending anchor portion 132. Couplers of this type are described in the referenced End Connector Patent.

The head portion 131 is undercut and is configured to be received in such grooves as are formed in the sides and bottom of the component 100. The anchor portion 132 has a central stem 133 and four radially extending wings 134. The stem 133 has a downwardly opening bore 135. One end region of a pin 136 is pressed into the bore 135. The other end region of the pin 136 depends below the stem 133. Both end regions of the pin 136 are provided with circumferentially extending, saw-tooth shaped ridges.

The anchor portion 132 and the pin 136 are received within and secured to the block 100 as described in the referenced End Connector Patent. The wings 134 extend slightly above the top face 104, as described in the referenced End Connector Patent.

The dimensions of the component 100 are preferably selected such that its width and height and thickness are multiples of a common dimensional unit. The width of the component 100, i.e., the distance between the side faces 103, 104 is preferably 2 units long. The height of the component 100, i.e., the distance between the top and bottom faces 105, 106, is preferably 1 unit long. The thickness of the component 100, i.e., the distance between the side faces 101, 102, is preferably 1 unit long.

The body of the component 100 is preferably formed from a relatively hard synthetic plastic material. The couplers 121, 122, 123 are preferably formed from somewhat more elastic synthetic plastic material. The coupler pins 136 are preferably formed from metal.

An enlarged recess 115 of substantially cubical shape is formed at the juncture of the side and bottom face grooves 114, 116. The recess 115 has cubical dimensions which are no less than the maximum width of the grooves 114, 116 and will loosely receive one of the couplers 121, 122, 123 to guide such coupler for insertion longitudinally into one of the grooves 114, 116.

Components having recesses of this type are shown in the referenced End Connector Patent.

The bottom face groove 116 is elongated and has a pair of spaced "first portions" 141. A plurality of "second portions" 142 extend longitudinally from opposite sides of the first portions 141. The side-by-side first and second portions 141, 142 define the length of the bottom face groove 116.

The first and second portions 141, 142 differ from each other when viewed in cross section in the degree to which they are undercut. Referring to FIG. 6, the first portions 141 are undercut only to a relatively small degree whereby one of the coupler head portions 131 can be inserted into the first groove portion 141 by pressing it through constricted groove portion parts 143 located near the bottom face 106. A "snap-together," relatively low tensile strength connection is established when a coupler head portion 131 is inserted in this fashion into the first groove portion 141.

Referring to FIG. 7, the second groove portions 142 are undercut to a much greater degree. A coupler head portion 131 can be inserted into the second groove portions 142 by sliding it longitudinally of the second groove portions 142. Insertion of a coupler head portion 131 into the second groove portions 142 can, of course, be effected by inserting the coupler head portion 131 from a position adjacent one of the side faces 103, 104, or from positions of engagement with the first groove portions 141. A "slide-together" relatively high tensile strength connection is established when a coupler head portion 131 is inserted into a second groove portion 142 inasmuch as the inserted coupler head portion cannot be removed transversely of the second groove portion except by damaging either the inserted coupler or the receiving second groove portion.

A feature of the first and second groove portions 141, 142 is that they are operable to respectively establish relatively low strength and relatively high strength tensile connections with a component 100 having one of its couplers 121, 122, 123 inserted respectively therein. Moreover, a high strength tensile connection can be established in two stages between a pair of the components 100 by first inserting one or more of the couplers 121, 122, 123 of one component into the first groove portions 141 of the other component, and then by relatively moving the components to slide the inserted couplers of the one component into engagement with the second groove portions 142 of the other component.

Referring to FIG. 8, one manner in which a plurality of the components 100 can be interconnected is shown. In FIG. 8, some of the components 100 have been assembled in two layers to form an L-shaped or right angle recess 150, and another of the components 100 is being moved, as indicated by an arrow 151, into the recess 150. As the moving component 100 assumes its assembled position, an upper layer coupler 123 is slidably received in a side face groove 113, and two lower layer couplers 121, 122 are snap-fitted into bottom face first groove portions 141. Once the upper layer of the components 100 has been assembled, it can be shifted longitudinally relative to the lower layer to establish relatively high tensile strength connections between the components of the upper and lower layers.

Figure 9:
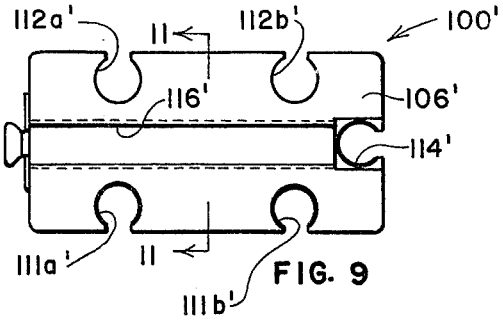
FIGS. 9 and 10 are bottom plan views of alternate component embodiments.
Figure 11:
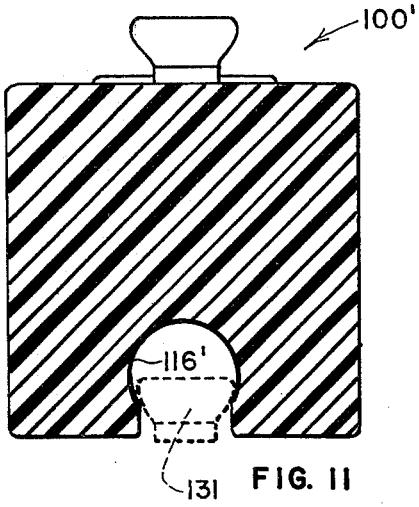
FIGS. 11 and 12 are enlarged sectional views as seen from planes indicated by lines 11—11 and 12—12 in FIGS. 9 and 10; and, FIG. 13 is a side elevational view illustrating how the components of FIGS. 9 and 10 may be interconnected.

Referring to FIGS. 9 and 11, an alternate component embodiment 100' is identical to the described component 100 except for the bottom face groove 116' having a uniform cross section along its entire length which is identical to that of the described first groove portion 141. The component 100' may be said to have as its "first groove portion" the entire bottom face groove 116', and as its "second groove portions" all the side face grooves **111*a'*, 111*b'*, 112*a'*, 112*b'*, 114'.**

Figure 10:
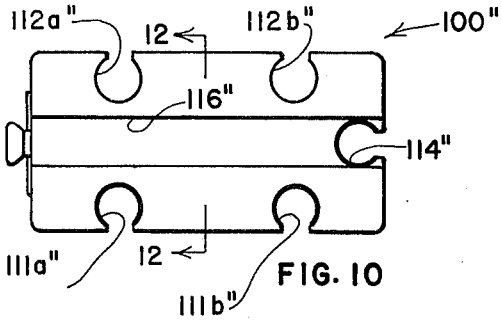
Figure 12:
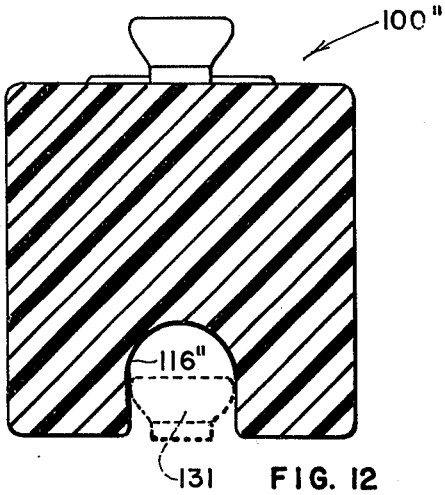

Referring to FIGS. 10 and 12, still another, less preferred, alternate component embodiment 100" is shown. The component 100" is identical to the components 100, 100' except for the bottom face groove 116" and except for the elimination of the cubical recess 115 present in block 100. In FIG. 10, the recess 116" is of uniform width throughout its length. The bottom face groove 116" is not undercut but rather simply has a width adapted to receive the coupler head portion 131 in an interference fit. The component 100" may therefore be said to have as its "first groove portion" the bottom face groove 116", and as its "second groove portions" all the side face grooves **11*a"*, 111*b"*, 112*a"*, 112*b"*, 114". The bottom face groove 116" can, of course, in the manner of the groove 116, be provided with side-by-side first and second groove portions where the first groove portions have the configuration of the groove 116" and the second groove portions have either the configuration of the portions 141 or the portions 142.**

Figure 13:
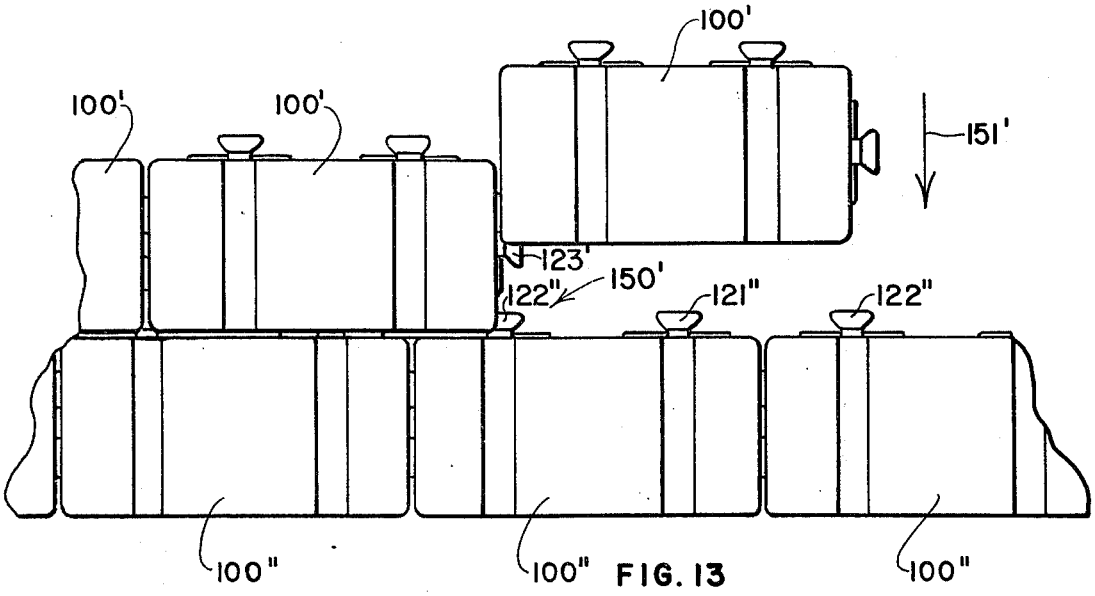

Referring to FIG. 13, the components 100', 100" can be assembled in much the same manner as the components 100. In FIG. 13, some of the components 100', 100" have been assembled in two layers to form an L-shaped or right angle recess 150', and another component 100' is being moved, as indicated by an arrow 151', into the recess 150'. As the moving component 100' assumes its assembled position, it slidably receives an upper layer coupler 123' and transversely receives two lower layer couplers 121", 122". A disadvantage of the components 100', 100" as compared with the component 100 is that the assembled upper and lower layers cannot be moved relatively to establish relatively high tensile strength connections between the components of the upper and lower layers.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed.

What is claimed is:

1. A construction set including a pair of components having engageable interfitting formations configured to securely releasably connect the components when such formations are interfittingly engaged, the formation on one component including projection means projecting substantially transversely from a face on the one component and being undercut in directions extending substantially transversely of such face, the formation on the other component including recess means having two recess portions one of which is undercut and adapted to slidingly engage the undercut projection means when the components are moved relatively to slide the one recess portion parallel to such face and into sliding engagement with the undercut projection means, the other of which is configured to receive and releasably retain the undercut projection means when the components are moved relatively transversely of such face to interfittingly engage the other recess portion and the undercut projection means, the two recess portions being arranged side-by-side and being associated with a common face of the other component.

2. The construction set of claim 1 wherein the other recess portion is undercut to a lesser degree than is the one recess portion.

3. A construction set including a pair of components having engageable interfitting formations configured to securely releasably connect the components when such formations are interfittingly engaged, the formation on one component being associated with a face on the one component and being undercut in directions extending transversely of such face, the formation on the other component including two formation portions one of which is undercut and adapted to slidingly engage the formation on the one component when such components are moved relatively to slide the one formation portion parallel to such face and into sliding engagement with the undercut formation on the one component, the other of which is configured to receive and releasably retain the undercut formation on the one component when the components are moved relatively transversely of such face to interfittingly engage the other formation portion and the undercut formation on the one component, the two formation portions being arranged side-by-side and being associated with a common face of the other component.

4. The construction set of claim 3 wherein the formation of the one component is insertable into the first formation portion by relatively moving the components to slide the one formation portion into interfitting engagement with the formation on the one component after the formation on the one component has been inserted into interfitting engagement with the other formation portion.

5. A construction set including a pair of components each having substantially identical undercut male connector formations projecting from a first pair of orthogonally related faces and each having elongated grooves formed in a second pair of orthogonally related faces, the grooves being configured to receive and securely releasably retain such of the connector formations as are slidably inserted longitudinally therein, at least one of the grooves on each component having portions which are undercut to a lesser degree than other groove portions to receive and releasably retain such of the connector formations as are pressed transversely into such lesser undercut portions, and said lesser undercut portions being adjacent said other portions, being in communication with each other and being mutually aligned, thereby enabling the connector formations to be longitudinally inserted into such other portions after having been inserted into such lesser undercut portions.

6. A construction set, comprising:

a. a first component having a face and an undercut connector formation projecting from the face;

b. a second component having first and second planar surface regions, and first and second groove portions formed respectively therein;

c. the first groove portion being configured to receive and securely releasably retain the connector formation inserted therein along a path extending substantially orthogonally of the first planar surface region as by pressing the connector formation into a part of the first groove portion which opens through the first planar surface region;

d. the second groove portion being elongated and configured to receive and securely releasably retain the connector formation inserted therein along a path extending substantially parallel to the second planar surface region as by sliding the connector formation longitudinally of and into the second groove portion, and, e. the first and second planar surface regions being adjacent regions of a common planar surface, and the first and second groove portions being adjacent portions of a common elongated groove formed in the common planar surface.

7. The construction set of claim 6 wherein both of the first and second groove portions are undercut and the first groove portion is undercut to a lesser degree than is the second groove portion.

8. The construction set of claim 6 wherein the first groove portion is configured to receive the connector formation in an interference fit, and the second groove portion is undercut.

9. The construction set of claim 13 wherein the first and second groove portions have different crosssectional configurations which, when receiving the connector formation, are operable, respectively, to establish a relatively low tensile strength connection and a relatively high tensile strength connection between the components.

* * * * *